US007632455B2

(12) United States Patent
Menon et al.

(10) Patent No.: US 7,632,455 B2
(45) Date of Patent: Dec. 15, 2009

(54) HIGH TEMPERATURE NIOBIUM ALLOY

(75) Inventors: Sarath Menon, Beavercreek, OH (US); Madan Mendiratta, Beavercreek, OH (US)

(73) Assignee: UES, Inc., Dayton, OH (US)

( * ) Notice: Subject to any disclaimer, the term of this patent is extended or adjusted under 35 U.S.C. 154(b) by 509 days.

(21) Appl. No.: 11/173,881

(22) Filed: Jul. 1, 2005

(65) Prior Publication Data

US 2007/0020136 A1 Jan. 25, 2007

(51) Int. Cl.
*C22C 27/02* (2006.01)

(52) U.S. Cl. ..... 420/426; 148/422

(58) Field of Classification Search ..... 420/425, 420/426; 148/422
See application file for complete search history.

(56) References Cited

U.S. PATENT DOCUMENTS

| | | | | |
|---|---|---|---|---|
| 2,741,455 | A * | 4/1956 | Hunter | 415/110 |
| 2,838,396 | A | 6/1958 | Rhodin, Jr. et al. | |
| 3,028,236 | A | 4/1962 | Wlodek et al. | |
| 3,037,858 | A | 6/1962 | Weisert et al. | |
| 3,066,578 | A | 12/1962 | Olton | |
| 3,632,225 | A * | 1/1972 | Smith et al. | 415/169.4 |
| 3,849,124 | A * | 11/1974 | Villani | 420/422 |
| 4,836,849 | A | 6/1989 | Svedberg et al. | |
| 5,180,446 | A | 1/1993 | Tsukuta et al. | |
| 5,296,309 | A | 3/1994 | Benz et al. | |
| 5,366,565 | A * | 11/1994 | Jackson | 148/426 |
| 5,741,376 | A | 4/1998 | Subramanian et al. | |
| 5,942,055 | A * | 8/1999 | Jackson et al. | 148/422 |
| 6,419,765 | B1 | 7/2002 | Jackson et al. | |
| 6,447,623 | B1 | 9/2002 | Jackson et al. | |
| 2006/0147335 | A1 * | 7/2006 | Bewlay et al. | 420/425 |

OTHER PUBLICATIONS

Chan, Kwai S., "Alloying effects on fracture mechanisms in Nb-based intermetallic in-situ composites," Materials Science and Engineering A329-331 (2002) pp. 513-522.*

Subramanian, P.R.; Mendiratta, M.G.; Dimiduk, D.M.; Stucke, M.A.; "Advanced intermetallic alloys -beyond gamma titanium aluminides," Materials Science and Engineering A239-240 (1997) pp. 1-13.*

Smallman, R.E. and R.J. Bishop, "Atomic arrangements in materials," Modern Physical Metallurgy and Materials Engineering, 6th edition, Butterworth Heinemann (1999), pp. 11-30.*

D.M. Dimiduk, M.G. Mendiratta and P.R. Subramanian, "Developmen appoarches for advanced intermetallic materials—Historical perspective and selected successes," Structural Intermetallics, Eds. R. Darolia, J.J. Lewandowski, C.T. Liu, P.L. Martin, D.B. Miracle and M.V. Nathal (TMS, 1993) 619-630.

(Continued)

*Primary Examiner*—George Wyszomierski
*Assistant Examiner*—Vanessa Velasquez
(74) *Attorney, Agent, or Firm*—Dinsmore & Shohl LLP

(57) ABSTRACT

Niobium alloy compositions and systems comprising the niobium alloy composition are provided. The niobium alloy compositions comprises between about 10 atomic % and about 30 atomic % of titanium, between about 7 atomic % and about 20 atomic % of silicon, between about 5 atomic % and about 20 atomic % of molybdenum, between about 2 atomic % and about 10 atomic % of chromium, between about 2 atomic % and about 10 atomic % of aluminum, between about 3 atomic % and about 7 atomic % of zirconium, between about 1 atomic % and about 7 atomic % of carbon, between about 1 atomic % and about 6 atomic % of hafnium, and niobium.

20 Claims, 3 Drawing Sheets

OTHER PUBLICATIONS

B.P. Bewlay, M.R. Jackson, J.-C. Zhao, P.R. Subramanian, M. G. Mendiratta and J. J. Lewandowski, "Ultrahigh-Temperature Nb-Silicide-based composites", MRS Bulletin 28 (2003) 646-653.

Hlgh-temperature Niobium Alloys: Eds. J. J. Stephens and I. Ahmad, Proceedings of a sympoium, TMS, 1991. considered Jul. 9, 2008.

E.N. Sheftel and O.A. Bannykh, "Niobium base alloys", Proceedings of the 13th International Plansee Seminar, Eds. Bilstein and R. Eck, Metallwerk Plansee, Reutte (1993) 43-69.

P.R. Subramanian, M.G. Mendiratta and D.M. Dimiduk, "The Development of Nb-based advanced intermetallic alloys for structural applications, "J. of Met., 48 (1) (1996), 33-38.

E.N. Sheftel and O.A. Bannykh, "Principles of Alloying and design of structure of high-temperature high-strength niobium alloys, " Tungsten and Refractory Metals-1994, eds. A. Bose and R.J. Dowding (Metals Powder Industries Federation, New Jersey, 1995) 629-655.

M.R. Jackson, "Alloying concepts for Nb-base refractory metals," Tungsten and Refractory Metals-1994, eds. A. Bose and R. J. Dowding (Metals Powder Industries Federation, New Jersey, 1995) 665-672.

P.R. Subramanian, M.G. Mendiratta, D.M. Dimiduk and M.A. Stucke, "Advanced intermetallic alloys—beyond gamma titanium aluminides" Mat. Sci. Engg., A239-240 (1997) 1-13.

P.R. Subramanian, M.G. Mendiratta and D.M. Dimiduk, "Microstructures and mechanical behavior of Nb-Ti base beta + silicide alloys," High-temperature Silicides and Refractory Alloys, eds. C.L. Braint, J.J. Petrovic, B.P. Bewlay, A.K. Vasudeyan and H.A. Lipsitt (MRS, Pittsburgh, 1994) 491-502.

E.S.K. Menon, M.G. Mendiratta and D.M. Dimiduk, Niobium -Science and Technolgy, Proceedings of the International Symposium Niobium 2001, Published by Niobium 2001 Ltd., Bridgeville, PA 121-145.

Y. Murayama and S. Hanada, "High temperature strength, fracture toughness and oxidation resistance of Nb-Si-Al-Ti multiphase alloys", Sci. and Tech. of Adv. Matls., 3 (2002) 145-156.

J. Sha, H. Hirai, T. Tabaru, A. Kitahara, H. Ueno and S. Hanada, "Effect of carbon on microstucture and high-temperature strength of Nb-Mo-Ti-Si in situ composites prepared by arc-melting and directional solidification", Mat. Sci. Engg., A343 (2003) 282-289.

B.P. Bewlay, M.R. Jackson, J.-C. Zhao and P.R. Subramanian, "A Review of Very-High-Temperature Nb-Silicide-Based Composities", Met. And Mat. Trans., 34 A (2003) 2043-2052.

W-Y. Kim H. Tanaka and S. hanada, "Microstructure and high temperature strength at 1773 K of $Nb_{ss}/Nb_5Si_3$ composites alloyed with Molybdenum", Intermetallics, 10 (2002) 625-634.

J. Sha, H. Hirai, T. Tabaru, A. Kitahara, H. Ueno and S. Hanada, Mechanical properties of as-cast and directionally solidified Nb-Mo-W-Ti-Si in-situcomposites at high temperatures, Met. And Mat Transactions, 34A (2003) 85-94.

R. Tanaka, A. Kasama, M. Fujikura, I. lwanaga, H. tanaka and Y. Matsumura, "Newly developed Niobium-based superalloys for elevated temperature application", in Niobium for High temperature applications, Eds., Y-W Kim and T. Carneiro, TMS, 2004, p. 89-98.

E. Albert, E. Fromm and R. Kirchheim, Met. Trans. 14A, 2117 (1983).

E.S.K. Menon, M.G. Mendiratta and D. M. Dimiduk, "High temperature oxidation mechanisms in Nb-silicide bearing multicomponent alloys", Structural Intermettallics 2001, Eds. K.J. Hemker, D.M. Dimiduk, H. Clemens, R. Darolia, H. Inui, J.M. Larsen, V.K. Sikka, M. Thomas and J.D. Whittenberger (TMS, 2001) 591-600.

* cited by examiner

HIGH TEMPERATURE NIOBIUM ALLOY

FIELD OF THE INVENTION

The present invention relates generally to alloy compositions, and specifically to niobium alloy compositions operable to withstand oxidation.

BACKGROUND OF THE INVENTION

Advanced designs in turbine airfoils, in addition to numerous other industrial applications, have previously utilized alloys, such as nickel base superalloys, to provide superior mechanical properties. However, these nickel alloys have shown to be ineffective at surface temperatures above surface temperatures above 1000° C., for example, these Ni-base alloys soften above 1150° C. and melt at about 1350° C. As a result, designers in the turbine industry, and other industries have been trying to develop new high temperature alloys, including niobium alloys. As new industrial applications are developed utilizing niobium alloys, the need arises for improvements in alloy composition and properties, especially resistance to oxidation at high temperatures.

SUMMARY OF THE INVENTION

According to one embodiment of the present invention, a niobium alloy composition comprising between about 10 atomic % and about 30 atomic % of titanium, between about 7 atomic % and about 20 atomic % of silicon, between about 5 atomic % and about 20 atomic % of molybdenum, between about 2 atomic % and about 10 atomic % of chromium, between about 2 atomic % and about 10 atomic % of aluminum, between about 3 atomic % and about 7 atomic % of zirconium, between about 1 atomic % and about 7 atomic % of carbon, between about 1 atomic % and about 6 atomic % of hafnium, and niobium is provided.

According to another embodiment of the present invention, a niobium alloy composition comprising between about 10 atomic % and about 30 atomic % of titanium, between about 7 atomic % and about 20 atomic % of silicon, between about 5 atomic % and about 20 atomic % of molybdenum, between about 2 atomic % and about 10 atomic % of chromium, between about 2 atomic % and about 10 atomic % of aluminum, between about 3 atomic % and about 7 atomic % of zirconium, between about 1 atomic % and about 7 atomic % of carbon, between about 1 atomic % and about 6 atomic % of hafnium, between about 0 atomic % and about 2 atomic % of boron, between about 0 atomic % and about 2 atomic % of tin, and niobium is provided.

According to yet another embodiment of the present invention, a turbine system is provided. The turbine system comprises a turbine casing, and a plurality of rotor blades disposed inside the turbine casing, wherein the turbine casing, the rotor blades, and/or other components comprise a composition comprising between about 10 atomic % and about 30 atomic % of titanium, between about 7 atomic % and about 20 atomic % of silicon, between about 5 atomic % and about 20 atomic % of molybdenum, between about 2 atomic % and about 10 atomic % of chromium, between about 2 atomic % and about 10 atomic % of aluminum, between about 3 atomic % and about 7 atomic % of zirconium, between about 1 atomic % and about 7 atomic % of carbon, between about 1 atomic % and about 6 atomic % of hafnium, and niobium.

According to the present invention, the niobium alloy compositions, and systems utilizing the niobium alloy composition is advantageous, especially in the ability to withstand oxidation and cracking caused by oxidation. These and additional objects and advantages provided by the niobium alloy compositions of the present invention will be more fully understood in view of the following detailed description.

BRIEF DESCRIPTION OF THE DRAWINGS

The following detailed description of specific embodiments of the present invention can be best understood when read in conjunction with the drawings enclosed herewith. The drawing sheets include.

DETAILED DESCRIPTION

Figure 1A:
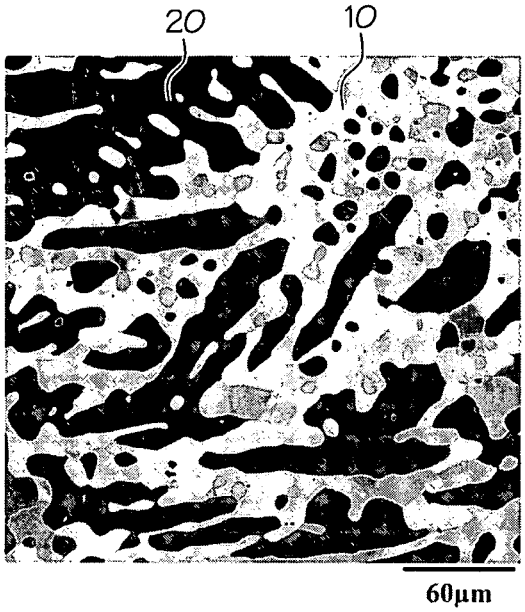
FIG. 1*a* is a micrograph of a non-Mo containing Nb alloy after heat treatment at 1500° C., according to one or more embodiments of the present invention.

The present application is directed to niobium alloy compositions generally, and specifically to high temperature niobium alloy compositions operable to withstand oxidation. According to one embodiment, a niobium alloy composition comprising between about 10 atomic % and about 30 atomic % of titanium, between about 7 atomic % and about 20 atomic % of silicon, between about 5 atomic % and about 20 atomic % of molybdenum, between about 2 atomic % and about 10 atomic % of chromium, between about 2 atomic % and about 10 atomic % of aluminum, between about 3 atomic % and about 7 atomic % of zirconium, between about 1 atomic % and about 7 atomic % of carbon, between about 1 atomic % and about 6 atomic % of hafnium, and niobium.

Table 1 below lists numerous experimental alloys in accordance with the present invention.

TABLE 1

| Alloy | Nb | Ti | Si | Mo | Al | Cr | Hf | Zr | C | B | W | Sn | Ge |
|---|---|---|---|---|---|---|---|---|---|---|---|---|---|
| E18 | 35.6 | 12.7 | 13.7 | 9.9 | 11.0 | 5.3 | 5.1 | 4.8 | 2.0 | — | — | — | — |
| E19 | 21.8 | 12.4 | 13.9 | 19.2 | 9.6 | 8.6 | 5.0 | 4.9 | 2.0 | 2.4 | — | — | — |
| E23 | 42.9 | 24.0 | 13.9 | — | 2.2 | 9.6 | 1.9 | — | 2.3 | 2.4 | — | 0.73 | — |
| E24 | 27.3 | 23.2 | 12.2 | 13.6 | 4.5 | 8.8 | 1.8 | — | 2.0 | 5.4 | — | 1.05 | — |
| E25 | 27.7 | 24.4 | 14.6 | 15.0 | 2.5 | 8.5 | 1.8 | — | 2.2 | 2.3 | — | 0.86 | — |

TABLE 1-continued

| Alloy | Nb | Ti | Si | Mo | Al | Cr | Hf | Zr | C | B | W | Sn | Ge |
|---|---|---|---|---|---|---|---|---|---|---|---|---|---|
| E26 | 24.6 | 24.7 | 13.4 | 18.7 | 2.5 | 8.8 | 1.8 | — | 2 | — | — | — | — |
| E27 | 21 | 23 | 14 | 10 | 10 | 10 | 5 | 5 | 2 | — | — | — | — |
| E28 | 17 | 23 | 18 | 10 | 10 | 10 | 5 | 5 | 2 | — | — | — | — |
| E29 | 45 | 25 | 19 | — | 2 | 5 | 3 | — | — | — | 1 | 1 | — |
| E30 | 35 | 25 | 19 | 10 | 2 | 5 | 3 | — | — | — | 1 | 1 | — |
| E31 | 30.5 | 19.9 | 14.1 | 10.0 | 8.9 | 4.6 | 4.9 | 5.3 | 2.0 | — | — | — | — |
| E32 | 27.7 | 19.6 | 16.7 | 9.9 | 9.0 | 4.7 | 4.8 | 5.2 | 2.4 | — | — | — | — |
| E33 | 26.7 | 19.5 | 19.1 | 9.5 | 7.9 | 4.2 | 5.1 | 5.5 | 2.5 | — | — | — | — |
| E34 | 29.9 | 19.9 | 18.0 | 10.2 | 4.7 | 4.6 | 5.0 | 5.3 | 2.3 | — | — | — | — |
| E35 | 33.5 | 16.1 | 14.3 | 10.3 | 9.2 | 5.0 | 4.6 | 5.3 | 1.9 | — | — | — | — |
| E36 | 23.1 | 20.7 | 13.1 | 9.8 | 7.3 | 4.7 | 5.1 | 7.7 | 8.0 | 0.3 | — | — | — |
| E37 | 21.2 | 20.2 | 15.9 | 9.4 | 8.4 | 5.1 | 4.7 | 7.7 | 4.6 | 0.3 | 2.2 | — | — |
| E38 | 25.2 | 15.3 | 15.8 | 9.5 | 8.1 | 5.0 | 5.1 | 5.8 | 4.4 | 0.3 | 5.4 | — | — |
| E39 | 35.6 | — | 15.8 | 15.6 | 6.5 | — | 5.0 | 11.0 | 4.6 | 0.4 | 5.2 | — | — |
| E40 | 52.0 | 13.0 | 14.1 | 19.7 | 0.3 | — | — | — | 0.2 | 0.4 | — | — | — |
| E41 | 36.4 | 12.8 | 14.2 | 20.3 | 3.4 | — | — | 5.3 | 5.1 | 2.4 | — | — | — |
| 2 | 44.9 | 26.0 | 12.6 | — | 1.92 | 6.73 | 1.9 | — | — | 0.3 | — | 0.5 | 4.9 |
| 2A | 33.0 | 22.9 | 12.3 | 9.8 | 2.7 | 4.9 | 2.9 | 3.3 | 2.2 | — | — | — | 5.8 |
| 2B | 30.3 | 21.3 | 12.1 | 14.9 | 2.7 | 4.8 | 2.9 | 3.1 | 1.9 | — | — | — | .9 |
| 2C | 29.1 | 18.5 | 11.1 | 19.2 | 2.9 | 4.8 | 3.0 | 3.2 | 2.0 | — | — | — | 6.0 |
| 2AA | 35.9 | 23.6 | 9.7 | 9.4 | 2.9 | 4.6 | 2.8 | 3.2 | 2.0 | — | — | — | 5.8 |
| 2CA | 30.5 | 18.6 | 9.8 | 19.1 | 2.8 | 5.0 | 3.0 | 3.3 | 1.8 | — | — | — | 5.9 |

Figure 1B:
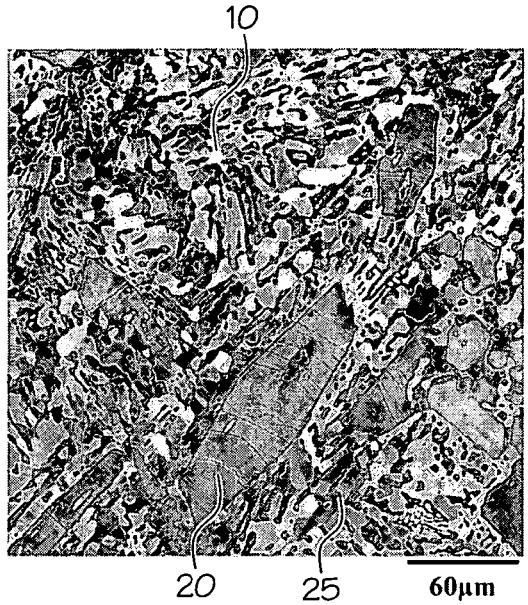
FIG. 1*b* is a micrograph of a Mo containing Nb alloy after heat treatment at 1500° C., according to one or more embodiments of the present invention.
Figure 1C:
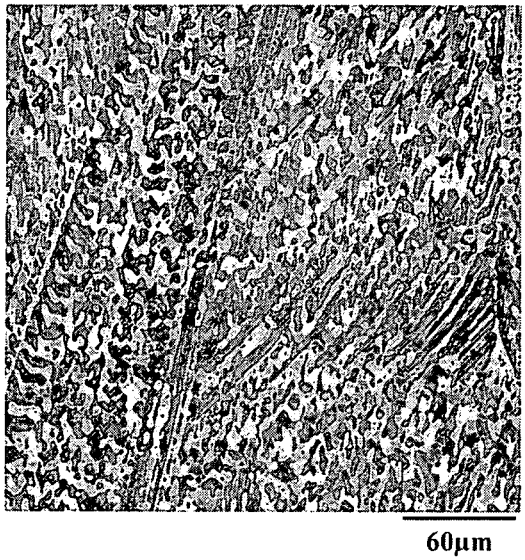
FIG. 1*c* is a micrograph of another Mo containing Nb alloy after heat treatment at 1500° C., according to one or more embodiments of the present invention.
Figure 1D:
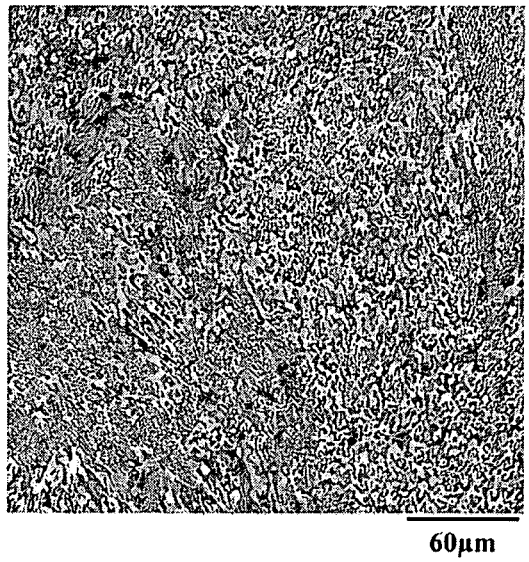
FIG. 1*d* is a micrograph of yet another Mo containing Nb alloy after heat treatment at 1500° C., according to one or more embodiments of the present invention.

In accordance with further embodiments of the present invention, the niobium alloy composition may comprise a niobium containing body centered cubic (bcc) solid solution phase, and may also comprise a silicide phase characterized by a substantially uniform distribution of fine $Nb_5Si_3$ particles and a tetragonal crystal structure. The silicide phase also comprises Ti, Hf, Mo and any other alloying elements present in the alloy. A hexagonal structure may negatively impact the creep resistance of the alloys, thus a tetragonal crystal structure is preferred. The silicide phase comprises a tetragonal crystal structure defined by a base dimension a and height dimension c. Referring generally to FIGS. 1*a* through 1*d*, increasing the atomic % of Mo in the alloy composition results in finer silicide phases 20 (dark regions in 1*a* through 1*d*). In FIG. 1*a*, alloy 2, which lacks Mo, comprises large non-uniform silicide phases 20. In FIG. 1*b*, alloy 2A, which contains 9.8 atomic % Mo, comprises fine uniform silicide phase 25 and substantially fewer large non-uniform silicide phases 20. Referring to FIG. 1*c*, which illustrates the structure of alloy 2B comprising (14.9 atomic % Mo), and FIG. 1*d*, which illustrates the structure of alloy 2C (19.2 atomic % Mo), increasing amounts of Mo in the alloy composition leads to finer silicide particles and the substantial elimination of large silicide phases 25 as shown in FIGS. 1*c*, and 1*d*.

In another embodiment, the niobium alloy composition defines a substantially eutectic mixture. The eutectic mixture is operable to produce fine, uniform silicide particles. The silicide phase may be distributed as particles in the bcc solid solution phase. Moreover, the eutectic mixture may also reduce the amount of thermo-mechanical processing of the alloy. Because the eutectic mixture, by definition, has the lowest possible melting point of any Nb alloy composition with these elements, the casting of the alloys may be easier due to narrower freezing ranges in alloys close to the eutectic compositions. Consequently, casting defects may be minimized.

In further embodiments, the niobium alloy composition may be operable to substantially reduce oxidation at temperatures ranging from between about 600° C. to about 1500° C. Oxidation poses problems for alloys at high temperatures. During high temperature exposure in an oxidizing environment, oxygen diffuses, dissolves and precipitates in the bcc solid solution phase. In addition, it has been found that during oxidation at temperatures below about 1200° C., precipitation of the oxide leads to cracking of the silicide phase. The niobium alloy composition of the present invention is operable to combat oxidation, due to its alloy composition, specifically through the addition of Mo to the alloy. For example, the addition of Mo may increase the thermodynamic activity of oxygen in the alloy and may also decrease the solubility of oxygen in the alloy. In addition, Mo additions to Nb may decrease the diffusivity of oxygen in Nb solid solution, and consequently decrease the oxide thickness in the alloy. In one embodiment as shown generally in FIGS. 3*a* and 3*b*, the niobium alloy composition is operable to reduce oxygen diffusion into the niobium alloy composition, such that oxygen diffuses a distance less than half as deep in the niobium alloy composition as a niobium alloy composition not containing Mo.

Figure 2A:
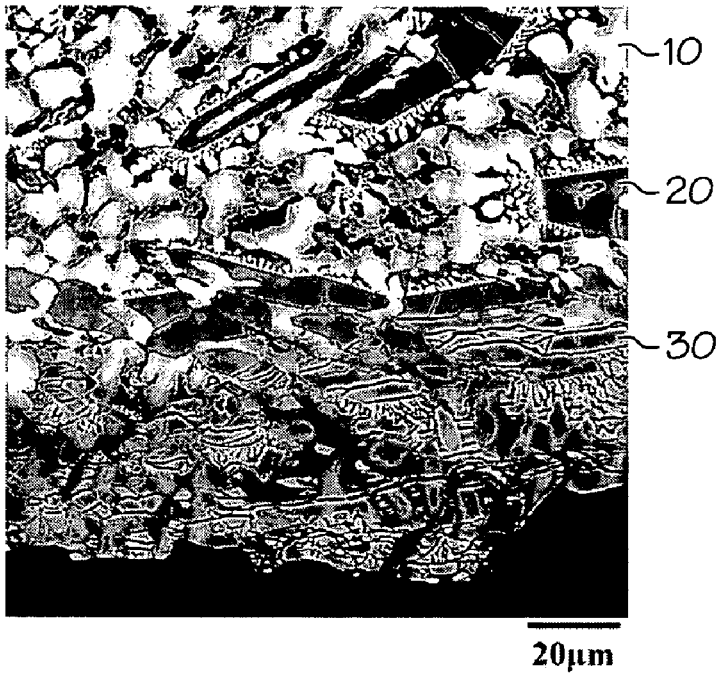
FIG. 2*a* is a micrograph of a non-Mo containing Nb alloy oxidized for 24 hours at 800° C., according to one or more embodiments of the present invention.
Figure 2B:
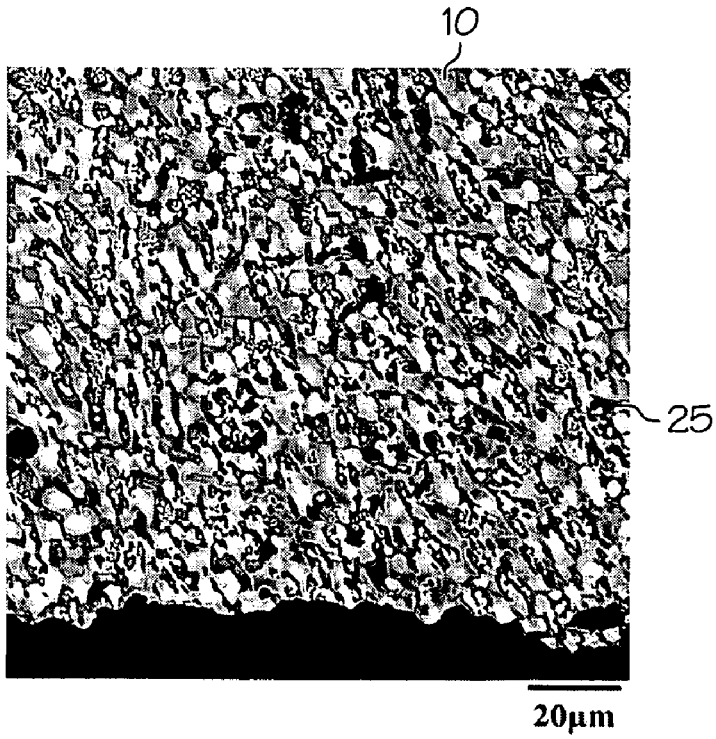
FIG. 2*b* is a micrograph of a Mo containing Nb alloy oxidized for 24 hours at 800° C., according to one or more embodiments of the present invention.

In a further embodiment, the presence of fine $Nb_5Si_3$ particles in the silicide phase 25, as shown in FIG. 2*b*, provides increased strength to the alloy. The suicide phase 25, which may be distributed inside the bcc solid solution phase 10, may comprise fine, uniform $Nb_5Si_3$ particles that are operable to act as reinforcing particles for the alloy, and are operable to substantially eliminate cracking, especially cracking due to oxidation. In contrast, large silicide phases 20, as shown in FIG. 2*a*, are more susceptible to cracking as demonstrated by the numerous cracks 30 within the silicide phase 20.

Figure 3A:
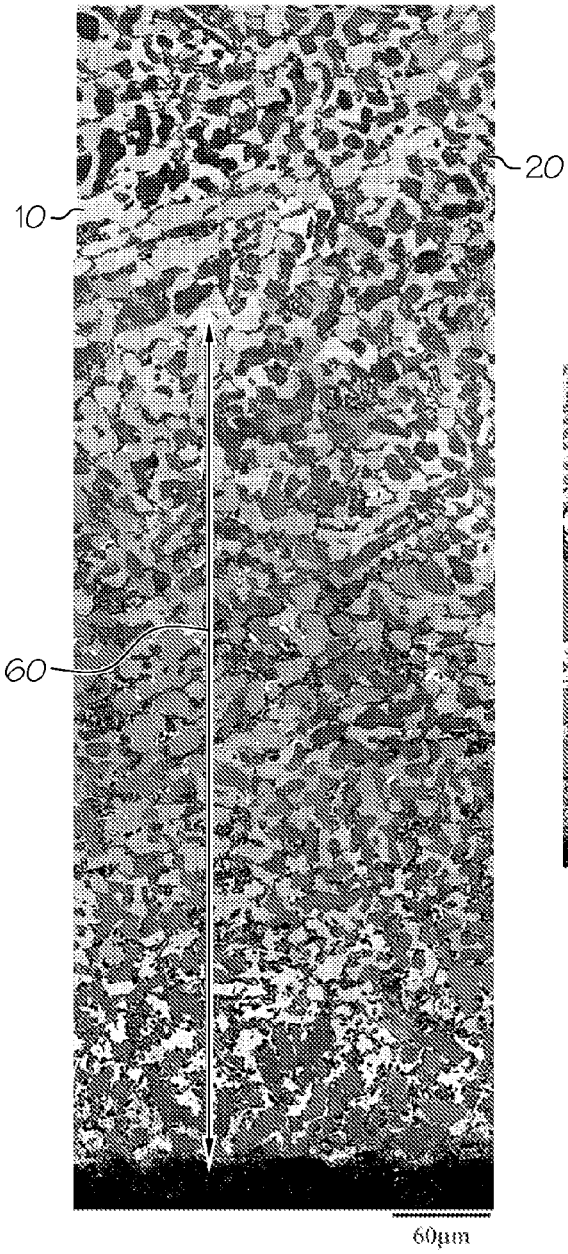
FIG. 3*a* is a micrograph of a non-Mo containing Nb alloy oxidized for 24 hours at 1200° C., according to one or more embodiments of the present invention.
Figure 3B:
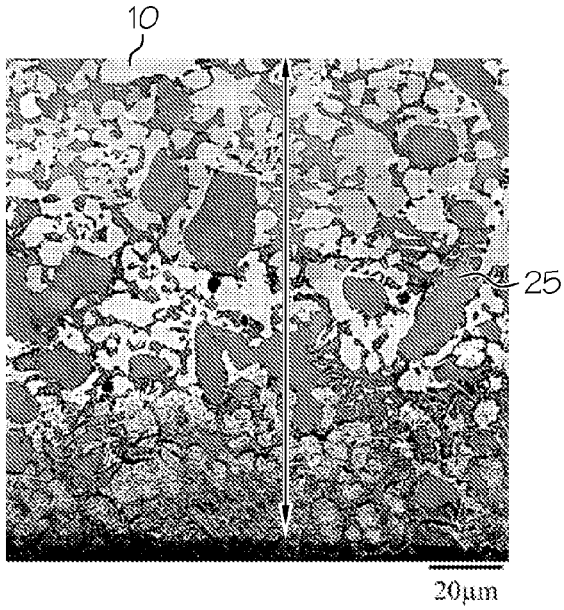
FIG. 3*b* is a micrograph of a Mo containing Nb alloy oxidized for 24 hours at 1200° C., according to one or more embodiments of the present invention.

For oxidation at 800° C. as shown in FIGS. 2*a* and 2*b*, the E29 alloy, which lacks Mo, comprises a large silicide phase 20 with numerous cracks 30, and the E30 alloy, which contains 10 % Mo, contain fine $Nb_5Si_3$ particles 25 arranged uniformly in the bcc phase 10 with no cracks present. Further as illustrated in FIGS. 3*a* and 3*b*, oxygen diffusion and oxide thickness at high temperatures (1200° C.) is substantially reduced for the E30 alloy as compared to the E29 alloy. Even at a lower magnification in the Scanning Electron Microscope (SEM) of 60 μm as shown in FIG. 3*a*, E29 contains a much greater diffusion distance 60 than E30, as shown in FIG. 3*b*. Table 2 below further demonstrates the depth of resistance for the E29 and E30 alloys at 1000° C. and 1200° C., and also illustrates the oxide thickness for both alloys at 1000° C. and 1200° C.

TABLE 2

| Oxidation condition | Depth of observable internal oxidation in μm | | Thickness of oxide in μm | |
|---|---|---|---|---|
| | E29 | E30 | E29 | E30 |
| 1000° C. for 24 hours | 117-141 | 30-44 | 154-204 | 49-43 |
| 1200° C. for 24 hrs | 695-739 | 143-165 | 300-348 | 109-125 |

In further embodiments of the present invention, the body centered cubic solid solution comprises a lattice constant value that is less than a lattice constant for a body centered cubic solid solution phase in a non-Mo containing alloy. Furthermore, the tetragonal crystal structure comprises lower a dimension values and higher c dimension values as compared to a and c dimension values for a silicide phase in a non-Mo containing alloy. Table 3 below provides a comparison of the a and c values (in (Å) angstroms) for E29 (non-Mo containing alloy) and E30 (Mo containing alloy).

TABLE 3

| | E29 | E30 | Nb & $\alpha$-$Nb_5Si_3$ |
|---|---|---|---|
| $\beta$ | 3.261 ± 0.002 | 3.220 ± 0.001 | 3.3066 |
| a - $\alpha$-$Nb_5Si_3$ | 6.878 ± 0.002 | 6.813 ± 0.002 | 6.5698 |
| c - $\alpha$-$Nb_5Si_3$ | 12.754 ± 0.002 | 12.896 ± 0.002 | 11.887 |

According to another embodiment of the present invention, a niobium alloy composition comprising between about 10 atomic % and about 30 atomic % of titanium, between about 7 atomic % and about 20 atomic % of silicon, between about 5 atomic % and about 20 atomic % of molybdenum, between about 2 atomic % and about 10 atomic % of chromium, between about 2 atomic % and about 10 atomic % of aluminum, between about 3 atomic % and about 7 atomic % of zirconium, between about 1 atomic % and about 7 atomic % of carbon, between about 1 atomic % and about 6 atomic % of hafnium, between about 0 atomic % and about 2 atomic % of boron, between about 0 atomic % and about 2 atomic % of tin, and niobium.

According to yet another embodiment of the present invention, a turbine system is provided. The turbine system comprises a turbine casing, and a plurality of rotor blades disposed inside the turbine casing, wherein the turbine casing, the rotor blades, and/or other components comprise a composition comprising between about 10 atomic % and about 30 atomic % of titanium, between about 7 atomic % and about 20 atomic % of silicon, between about 5 atomic % and about 20 atomic % of molybdenum, between about 2 atomic % and about 10 atomic % of chromium, between about 2 atomic % and about 10 atomic % of aluminum, between about 3 atomic % and about 7 atomic % of zirconium, between about 1 atomic % and about 7 atomic % of carbon, between about 1 atomic % and about 6 atomic % of hafnium, and niobium.

In further embodiments, the composition of the turbine system may be defined by a plurality of phases including a niobium containing body centered cubic solid solution phase, and a silicide phase characterized by a substantially uniform distribution of fine $Nb_5Si_3$ particles and a tetragonal crystal structure. The composition is operable to substantially reduce cracking due to oxidation at temperatures ranging from between about 600° C. to about 1500° C.

The niobium alloy may be produced by any method known to one of ordinary skill in the art. In one embodiment, the alloys were prepared by argon inert gas arc melting of the component elements.

These niobium alloy compositions may be used in a wide variety of high temperature structural applications, including aircraft engines, rocket propulsion and hypersonic vehicles by providing higher operational efficiency of turbine engines. Other commercial applications include the use of niobium alloys in land-based gas turbine engines, heat exchangers and energy conversion systems.

It is noted that terms like "specifically," "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A niobium alloy composition comprising:

between about 10 atomic % and 25 atomic % of titanium;

between about 7 atomic % and about 20 atomic % of silicon;

between 10 atomic % and about 20 atomic % of molybdenum;

between about 2 atomic % and about 10 atomic % of chromium;

between about 2 atomic % and about 10 atomic % of aluminum;

between about 3 atomic % and about 7 atomic % of zirconium;

between about 1 atomic % and about 7 atomic % of carbon;

between about 1 atomic % and about 6 atomic % of hafnium; and at least 25.2 atomic % niobium.

2. A niobium alloy composition according to claim 1, wherein the niobium alloy composition comprises a plurality of phases including a niobium containing body centered cubic (bcc) solid solution phase, and a silicide phase characterized by a substantially uniform distribution of fine $Nb_5Si_3$ particles and a tetragonal crystal structure.

3. A niobium alloy composition according to claim 2 wherein the bcc solid solution phase and the silicide phase are present in a eutectic mixture.

4. A niobium alloy composition according to claim 2 wherein the $Nb_5Si_3$ particles are operable to act as reinforcing particles for the alloy.

5. A niobium alloy composition according to claim 1 wherein the niobium alloy composition is operable to substantially reduce oxidation at temperatures ranging from between about 600° C. to about 1500° C.

6. A niobium alloy composition according to claim 1 wherein the niobium alloy composition is operable to substantially reduce cracking due to oxidation at temperatures below about 1200° C.

7. A niobium alloy composition according to claim 1 wherein the Mo is operable to increase the thermodynamic activity of oxygen and decrease the solubility of oxygen.

8. A niobium alloy composition according to claim 1 wherein the Mo is operable to increase the thermodynamic activity of oxygen in the alloy and decreases the solubility of oxygen in the alloy.

9. A niobium alloy composition according to claim 1 wherein the niobium alloy composition is operable to reduce oxide thickness in the niobium alloy composition as compared to a niobium alloy composition not containing Mo.

10. A niobium alloy composition according to claim 1 comprising between 2 atomic % and about 7 atomic % of carbon.

11. A niobium alloy composition according to claim 1 comprising between 0.3 atomic % and about 2 atomic % of boron and between 0.5 atomic % and about 2 atomic % of tin.

12. A niobium alloy composition comprising:

between about 10 atomic % and 25 atomic % of titanium;

between about 7 atomic % and about 20 atomic % of silicon;

between 10 atomic % and about 20 atomic % of molybdenum;

between about 2 atomic % and about 10 atomic % of chromium;

between about 2 atomic % and about 10 atomic % of aluminum;

between about 3 atomic % and about 7 atomic % of zirconium;

between about 1 atomic % and about 7 atomic % of carbon;

between about 1 atomic % and about 6 atomic % of hafnium;

between about 0 atomic % and about 2 atomic % of boron;

between about 0 atomic % and about 2 atomic % of tin; and at least 25.2 atomic % niobium.

13. A niobium alloy composition according to claim 12 comprising between 2 atomic % and about 7 atomic % of carbon.

14. A niobium alloy composition according to claim 12 comprising between 0.3 atomic % and about 2 atomic % of boron and between 0.5 atomic % and about 2 atomic % of tin.

15. A turbine system comprising:

a turbine casing;

a plurality of rotor blades disposed inside the turbine casing;

wherein the turbine casing, the rotor blades, and/or other components of the turbine system comprise a composition comprising between about 10 atomic % and 25 atomic % of titanium;

between about 7 atomic % and about 20 atomic % of silicon;

between 10 atomic % and about 20 atomic % of molybdenum;

between about 2 atomic % and about 10 atomic % of chromium;

between about 2 atomic % and about 10 atomic % of aluminum;

between about 3 atomic % and about 7 atomic % of zirconium;

between about 1 atomic % and about 7 atomic % of carbon;

between about 1 atomic % and about 6 atomic % of hafnium; and at least 25.2 atomic % niobium.

16. A turbine system according to claim 15 wherein the turbine component composition comprises a plurality of phases including a niobium containing body centered cubic (bcc) solid solution phase, and a silicide phase characterized by a substantially uniform distribution of fine $Nb_5Si_3$ particles and a tetragonal crystal structure.

17. A turbine system according to claim 15 wherein the turbine component composition is operable to substantially reduce oxidation at temperatures ranging from between about 6020 C. to about 1500° C.

18. A turbine system according to claim 15 wherein the turbine component composition is operable to substantially reduce cracking due to oxidation at temperatures below about 1200° C.

19. A turbine system according to claim 15 comprising between 2 atomic % and about 7 atomic % of carbon.

20. A turbine system according to claim 15 comprising between 0.3 atomic % and about 2 atomic % of boron and between 0.5 atomic % and about 2 atomic % of tin.

* * * * *

UNITED STATES PATENT AND TRADEMARK OFFICE

CERTIFICATE OF CORRECTION

PATENT NO. : 7,632,455 B2
APPLICATION NO. : 11/173881
DATED : December 15, 2009
INVENTOR(S) : Menon et al.

It is certified that error appears in the above-identified patent and that said Letters Patent is hereby corrected as shown below:

Col. 8, Line No. 32, Claim No. 17, "60020 C" should read --600°C--.

Signed and Sealed this

Twenty-seventh Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,632,455 B2
APPLICATION NO. : 11/173881
DATED : December 15, 2009
INVENTOR(S) : Menon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 614 days.

Signed and Sealed this

Second Day of November, 2010

David J. Kappos

David J. Kappos
*Director of the United States Patent and Trademark Office*